US005659901A

United States Patent [19]

Derakhshan

[11] Patent Number: 5,659,901

[45] Date of Patent: Aug. 26, 1997

[54] WATER CLOSET-MOUNTED BIDET KIT

[76] Inventor: Soheyl Derakhshan, 5355 Pacifica Dr., San Diego, Calif. 92109

[21] Appl. No.: 697,206

[22] Filed: Aug. 21, 1996

[51] Int. Cl.[6] ..... A47K 3/22

[52] U.S. Cl. ..... 4/420.1; 4/420.4; 4/447; 4/448; 137/580; 137/884

[58] Field of Search ..... 4/420.1, 420.2, 4/420.3, 420.4, 420.5, 443, 444, 447, 448; 251/149.9; 137/883, 884, 580

[56] References Cited

U.S. PATENT DOCUMENTS

| | | | |
|---|---|---|---|
| 1,752,782 | 4/1930 | Burton | 4/448 |
| 2,875,450 | 3/1959 | Umann | 4/420.2 |
| 5,263,205 | 11/1993 | Leunissen | 4/420.4 |
| 5,419,363 | 5/1995 | Robinson | 4/448 |
| 5,452,483 | 9/1995 | Dizon | 4/420.4 |

*Primary Examiner*—Henry J. Recla
*Assistant Examiner*—Charles R. Eloshway
*Attorney, Agent, or Firm*—Ralph S. Branscomb

[57] ABSTRACT

A personal hygiene fixture is provided as a retrofit unit designed to mount directly onto a toilet tank inlet, being interposed in the fresh water supply line where it attaches to the tank. The appliance has a diversion valve which diverts water from the supply line to a tube leading to an irrigation nozzle mounted to the underside of the toilet seat. The knob controlling the irrigation is part of the valve, and is thus rigidly mounted to the tank fill valve so that it is easy to install and operate. A second diversion valve with a flexible line leading to a douche wand can also be incorporated in the valve unit to provide a dual-function hygiene appliance.

6 Claims, 2 Drawing Sheets

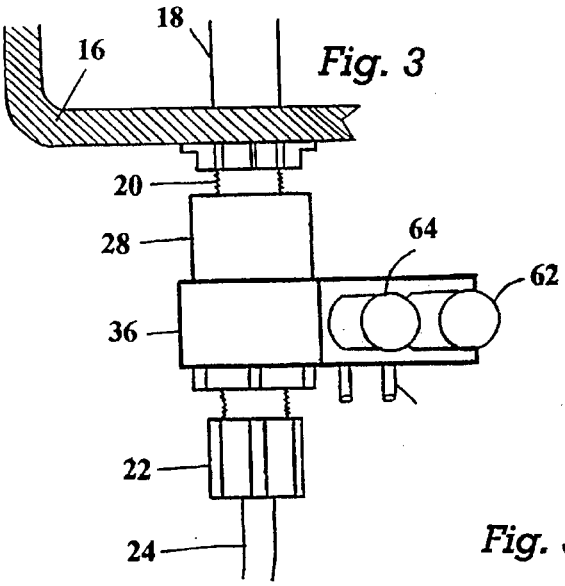
Fig. 3
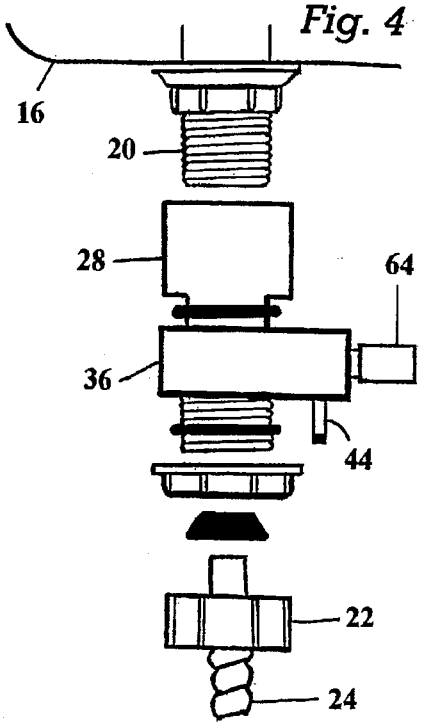
Fig. 4
Fig. 5
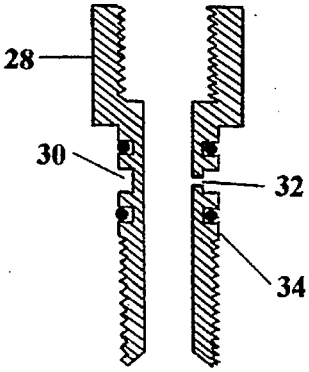
Fig. 8
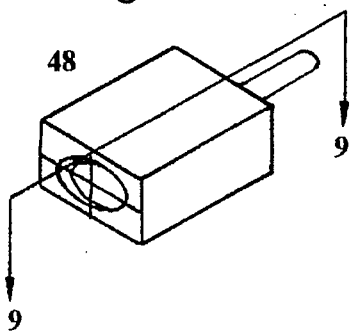
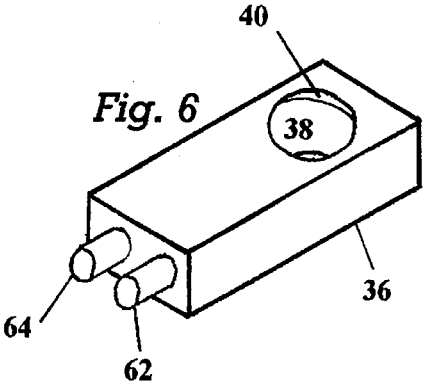
Fig. 6
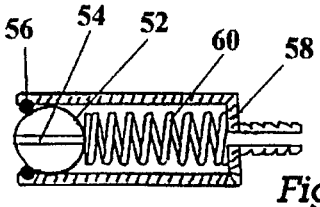
Fig. 9
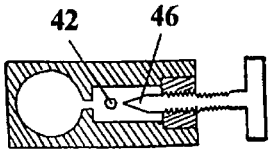
Fig. 7

WATER CLOSET-MOUNTED BIDET KIT

BACKGROUND OF THE INVENTION

Bidets are standard equipment in parts of Europe, but have never become popular in the United States for some reason. Perhaps it is the inconvenience and additional space required to install a second fixture, in addition to a toilet, that has undermined its popularity. Many think there is a need for a bidet, or at least there is a need felt by a substantial portion of the population as evidenced by the number of United States patents that have been issued, both design and utility, on bidets. The impracticality of many of these designs may also be as an obstacle to the acceptance of the bidet.

The issued patents disclose some bidet units which are original equipment and some that are aftermarket units. The original equipment designs are by and large out of the loop for the average person, who buys a residence, or rents an apartment, in which the plumbing is already installed. To work in the consumer market, a bidet would have to be a retrofitted appliance, sold as a kit to be added on to an existing toilet without need for additional parts or plumbing changes. Low cost and ease of installation would play a crucial role in the success of such a product.

The toilet-retrofit aftermarket models that are represented in the patented art are not solidly mounted to the water closet, or tank, of the toilet. Some that otherwise might be practical have a control valve which is mounted on a loose, flexible line dangling from the water closet, making it difficult to operate. Others fail to conform to a simple installation protocol, giving the appearance of being complicated to produce and difficult to install.

For an aftermarket unit to be practical, it is believed that it should be able to mount on nearly all types of toilets on the market, easy to install, easy to maintain, and have control knobs securely mounted in an easily accessible location.

SUMMARY OF THE INVENTION

The instant invention fulfills the above stated need by providing an aftermarket, toilet-retrofitted appliance which is mounted directly on the water supply inlet nipple that is found on the bottom of virtually every residential water closet. This nipple ordinarily is engaged by a gland nut on the supply line, and provides water to the ball check valve which shuts after the water closet is filled. All that is required to install the device is removal of the gland nut from the supply inlet nipple, and interpose therebetween what amounts to an adapter with a diversion valve. The water supply to the toilet is not interrupted, but water is diverted as needed to operate the appliance.

This valve-mounting technique provides a rigid yet adjustable, secure mounting for the valve so that the knob or knobs that control the valve or valves are easy to operate. They do not dangle, or yield to the touch. Furthermore, it is believed to be easiest way to tap into the water line for such an appliance.

A diversion valve in its simplest form defines an internal passageway controlled by a needle valve or the equivalent, which communicates to an irrigation outlet. This outlet connects to a flexible hose having a nozzle at its distal end. The nozzle is mounted on the underside of a toilet seat to irrigate the user. In this basic embodiment, the appliance is equally useful for both genders, and in actuality comes to completely replace bathroom tissue over time, at least for men.

In a modification in which two valve elements are used on two passageways, the second passageway communicates to a flexible tube having an irrigation wand at the end which can be positioned at the user's convenience, ordinarily used for external feminine hygiene, but is also quite useful for toilet cleaning.

With one or both irrigation functionalities, the ease of installation, the rigid mounting of the valve, the accessibility of its controls, and the retrofit nature of the appliance, lie at the heart of the invention and define its hope for success in the marketplace.

BRIEF DESCRIPTION OF THE DRAWINGS

FIG. 3 is an enlarged fragmentary detail of the invention mounted to a water closet fill valve;

FIG. 4 is substantially the same view as FIG. 3 but with the parts of the valve unit exploded;

FIG. 5 is a section taken longitudinally through the adaptor pipe which interfits between the inlet nipple of the water closet and the fresh water supply line;

FIG. 6 is a perspective view of the part of the valve that fits over the adaptor pipe to define the complete valve;

FIG. 7 is a somewhat diagrammatic top view of a single needle valve which diverts water from the fresh water intake, shown to illustrate its operation more than its construction;

FIG. 8 is a perspective view of the toilet seat-mounted nozzle; and,

FIG. 9 is a section taken through line 9—9 of FIG. 8.

ELEMENT NUMBER QUICK-LIST

Figure 1:
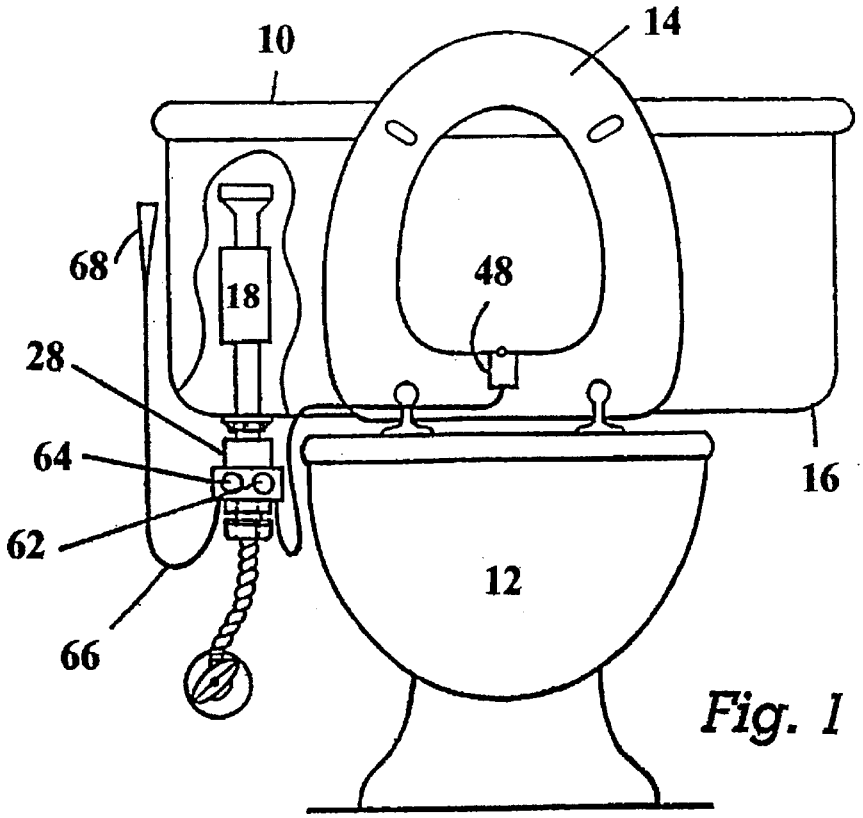
FIG. 1 is a front view, slightly diagrammatic, of a typical toilet with a water closet, having the seat in the up position.

10 toilet
12 bowl
14 seat
16 tank
18 fill valve mechanism
20 inlet, or inlet nipple
22 gland nut on supply line
24 supply line
26 valve-general indicator
28 adaptor pipe
30 annular channel
32 bore through channel
34 flat cylindrical valve seat
36 valve body
38 main vertical bore through valve body
40 bevels on bore through body
42 passageways for water through valve body
44 irrigation outlets at the ends of the passageways 42
46 needle valves
48 seat nozzle
50 first flexible tube
52 spherical nozzle
54 bore through the nozzle
56 O ring retainer
58 nozzle housing
60 coil spring and nozzle housing

62 first control knob for nozzle

64 second control knob for wand

66 second flexible tube-that connects to wand

68 irrigation wand at the end of tube 66

DETAILED DESCRIPTION OF THE PREFERRED EMBODIMENT

Figure 2:
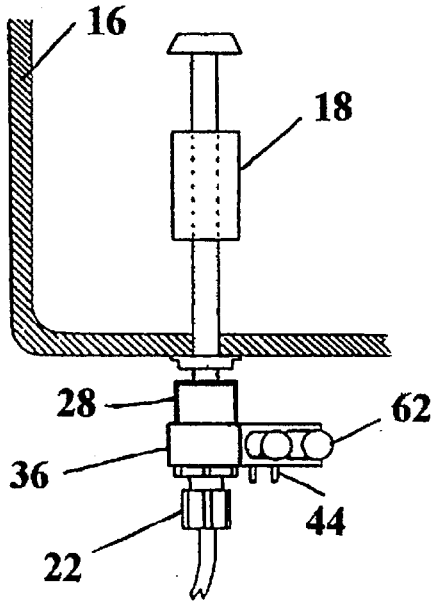
FIG. 2 is a fragmentary detail of the portion of the water closet to which the invention is mounted, showing the invention in place.

A typical toilet is shown in FIG. 1, having a bowl 12, with a seat 14 and a water closet or tank 16, all of which is shown in FIG. 1. A portion of the inside of the tank is shown in FIG. 2. In this figure it can be seen that the float valve 18 in the water closet is supplied with water through a water supply inlet 20 which terminates in the form of a threaded nipple as shown in FIG. 4. Ordinarily, this nipple is overfitted with the gland nut 22 which connects the nipple to the supply line 24, which comes out of the bathroom wall, not shown, and is controlled by an on/off valve.

To install the invention, the gland nut is removed from the nipple, and the valve body 36 is interfitted like an adapter between the nipple and the gland nut on the supply line. This is best visualized by reference to FIG. 4. The bore on valve body 36 then fits into adaptor 28. The valve body 36 controls the supply of fresh water to the toilet seat-mounted nozzle 48, and the hand held douche 68 if it is present.

The adaptor 28 has an annular channel 30 and a bore 32 at some point along the channel so that water from within the pipe is supplied to the annular channel, which makes it available from any point along the 360-degree circumference of the pipe. The annular channel is defined centrally on a flat cylindrical seat 34, over which is fitted the body 36 of the valve, which likewise can be mounted at any angular orientation about the axis of the adapter pipe. The cylindrical bore 38 of the valve body 36 is beveled as indicated at 40 on both the top and the bottom edges. These bevels seat O-rings which define a necessarily tight seal between the body and the seat 34, as full municipal water pressure is experienced by the valve. As can be seen, there is no interference with the water that passes up through the adapter pipe to the tank to fulfill the traditional roll of the toilet.

The valve body defines one or two internal passageways 42, which exit the body of the valve as irrigation outlets 44, shown in FIG. 2. The passageway is controlled by means of a needle valve 46, shown in FIG. 7. Rotating the needle moves it into its seat, sealing off the water entry to the inside of the valve body.

The valve body may have one or two of these passageways controlled by the respective needle valves. The first passageway operates a nozzle 48, shown in FIGS. 8 and 9, which is attached to the bottom of the toilet seat 14 as shown in FIG. 1, and receives water from the valve through the flexible tube 50. The nozzle could be glued, screwed, or otherwise securely fastened to the underside of the toilet seat.

It is the nature of the nozzle that it delivers water in the form of a solid stream, rather than a spray. As detailed in FIG. 9, a simple spherical ball 52 is retained by an O-ring 56 within the housing 58 of the nozzle, and is maintained in place by a coil spring 60. This arrangement is leak-proof and produces a solid stream of water. Once the nozzle has been installed on the toilet, the spherical ball 52 having a passageway 54 therethrough can be rotated with a hat pin or a needle to achieve the proper direction, where it is left permanently. Although, obviously it could be adjusted at any time, once it is set at the appropriate angle for a particular installation it would not ordinarily need further adjustment.

The basic embodiment of this invention as detailed above functions as a sanitation appliance for both genders, and actually does not perform the traditional function of a bidet. This function can be added with a second valve. If the second valve is used, such that there would be control knobs 62 and 64, the irrigation outlet of the second valve passageway would connect to a flexible line 66 just like the line 50 connected to the first outlet. At the end of the flex line 66 is an irrigation wand 68, provided primarily for external feminine use like a bidet, but also very convenient as a sprayer for bowl cleaning. Although either this irrigation device or the nozzle could be used without the other device, it is intended that the nozzle would be used if the unit is a single-function product, and of course the wand could be added for a dual function unit.

The illustrated embodiment is exemplary in nature, and many of the details could be modified. For example, the needle valves that control the irrigation outflow could be some other type of valve, such as momentary valves that close when released, or timed valves like Sloan® flush valves. The general shape of the valve apparatus could be different. Style-wise, it could be configured as a rudimentary utilitarian apparatus, or the valve made of brass with a "designer" look and fancy appurtenant parts. The nozzle 48 could be modified in its internal construction, or made entirely differently. The essentials of the invention are, the solid valve mounting on the tank refill inlet, and the retrofit design in which the valve is interposed between the fresh water supply line and the inlet nipple on the bottom of the water closet, for maximum ease of installation and security.

This arrangement is so simple and so easy to install, literally anyone who has the capability of walking into a store to buy it, would also have the capability of installing it. Its simplicity makes it inexpensive, and its solid mounting encourages its use, with the confidence that it will not fall off, misfire or otherwise fail.

It is hereby claimed:

1. For use with a toilet arrangement including a water closet having a water supply inlet with a mounting nipple and a water supply line adapted to be connected to said water supply inlet, a toilet hygiene fixture comprising:

(a) a controllable diversion valve adapted to be interposed between said water supply inlet and said water supply line, said diversion valve having at least one outlet and including an adaptor pipe adapted to be connected to said mounting nipple for passing water from said water supply line to said diversion valve;

(b) said adaptor pipe defining an external annular channel having a bore therethrough for communicating water from an interior of said adaptor pipe to said channel, said diversion valve having a body comprising a ring engageable over said annular channel of said adaptor pipe and a passageway connecting said ring with said at least one outlet, said valve further having at least one diversion valve element operative to selectively open and close a respective one of each said at least one outlet;

(c) a delivery line having a proximal end connected to said at least one outlet and a distal end connected to a nozzle; and, (d) means for mounting said nozzle to said toilet.

2. A toilet hygiene fixture according to claim 1 wherein said nozzle has means to mount same to the underside of a toilet seat.

3. A toilet hygiene fixture according to claim 2 wherein said nozzle is a solid stream nozzle and is angularly adjustable relative to a toilet seat to which it is mounted.

4. A toilet hygiene fixture according to claim 3 wherein said nozzle includes a socket and nozzle element which is at least partially spherical and rotatably mounted in said socket, and defines a bore therethrough to pass water.

5. For use with a toilet arrangement including a water closet having a water supply inlet with a mounting nipple and a water supply line adapted to be connected to said water supply inlet, a toilet hygiene fixture comprising:

(a) a controllable diversion valve adapted to be interposed between said water supply inlet and said water supply line;

(b) first and second irrigation outlets defined by said diversion valve;

(c) first and second delivery lines connected to said first and second irrigation outlets, respectively;

(d) said diversion valve further including two separately operable and controlled valved passageways communicating with said first and second irrigation outlets, respectively;

(e) a nozzle connected to a distal end of said first delivery line;

(f) an irrigation wand connected to a distal end of said second delivery line; and, (g) means for mounting said nozzle to said toilet.

6. A toilet hygiene fixture according to claim 5 wherein said valve is adapted to be mounted such that said knob-controlled passageways are readily controlled by a user seated on said toilet.

* * * * *